US005310372A

United States Patent [19]

Tibbetts

[11] Patent Number: 5,310,372

[45] Date of Patent: May 10, 1994

[54] THROUGH HULL ASSEMBLIES FOR MARINE DRIVES

[75] Inventor: Samuel H. Tibbetts, North Haven, Me.

[73] Assignee: The Evolution Company Inc., Camden, Me.

[21] Appl. No.: 853,923

[22] Filed: Mar. 19, 1992

[51] Int. Cl.[5] ..... B63H 23/36

[52] U.S. Cl. ..... 440/112; 277/15

[58] Field of Search ..... 440/83, 11, 112; 277/3, 277/15

[56] References Cited

U.S. PATENT DOCUMENTS 2,521,368 9/1950 Hingerty, Jr. .

4,395,141 7/1983 Pietsch et al. ..... 440/112

4,813,898 3/1989 Nakase et al. ..... 440/112

*Primary Examiner*—Jesus D. Sotelo

*Attorney, Agent, or Firm*—Abbott Spear

[57] ABSTRACT

A through hull assembly to be incorporated in a marine drive has a housing secured to the hull. The housing consists of a rearward tubular section and a forward section. The tubular section is of a length to extend through the hull and is connected and sealed thereto in a manner preventing leakage through the passageway through which the tubular section extends. A shaft extends through both housing sections and is sealed to opposite ends thereof and is supported by bearings in each section with the ends of the shaft exposed. The bearings in the forward section are accommodative of forward and rearward thrusts. A lubricant reservoir maintains the housing full with the lubricant level in the reservoir giving information if there is any housing leakage.

6 Claims, 4 Drawing Sheets

THROUGH HULL ASSEMBLIES FOR MARINE DRIVES

BACKGROUND OF THE INVENTION

Boats in a size range including those used in lobster and crab fishing, usually have a leakage problem where the propeller shaft extends through the hull.

The problem stems from the fact that seals and bearings are attached directly to the hulls thus limiting the types of seals and bearings which can be used and making their servicing, including bearing lubrication, difficult.

Another concern with marine drives is that of enabling thrusts to be accommodated. In that connection, reference is made to U.S. Pat. No. 2,521,368 describing a thrust bearing assembly to be incorporated between the inboard end of the propeller shaft and a universal joint adjacent the engine. The assembly has a housing, held against turning and sealed to the shaft and the universal joint, within which a stub shaft, connecting the propeller shaft and the universal joint, is supported by bearings accommodative of forward and rearward thrusts. In addition, provision was made for introducing a lubricant under pressure into the housing to lubricate the bearings.

THE PRESENT INVENTION

The general objective of the present invention is to provide through hull assemblies with each housing a shaft, spaced apart shaft seals, bearings and a lubrication system also acting as a gauge by which any shaft seal leakage can be detected.

This objective is attained with each assembly provided with an open ended housing dimensioned to extend through the hull with a rearward outboard portion exposed below the waterline; the housing also includes a forward section. A shaft extends through the housing with both ends exposed and sealed to the housing sections. The housing is connected to the hull to be held thereby against turning and is secured and sealed to the hull. The shaft is supported by bearings adjacent the inboard and outboard ends of the housing and these are spaced from those ends to provide recesses for shaft seals. The inboard bearings are of a thrust accommodating type.

The housing is dimensioned to be filled with oil and an important aspect of the invention is that the housing is connected to a reservoir for a lubricant in a manner such that the reservoir serves as a gauge enabling any leakage through the seals to be detected. The reservoir is located above the housing to provide a head on the lubricant and the lubricant may be pressurized.

Other aspects of the invention will be apparent from the accompanying description of presently preferred embodiments and the claims.

BRIEF DESCRIPTION OF THE DRAWINGS

The accompanying drawings illustrate preferred embodiments of the invention and

THE PREFERRED EMBODIMENTS

Figure 1:
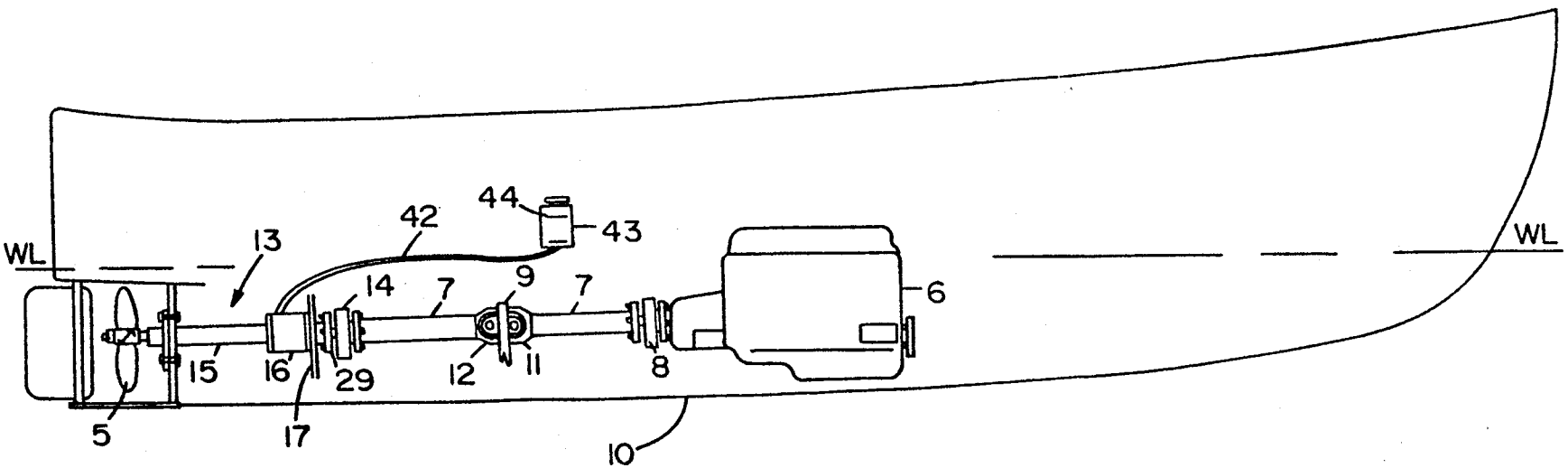
FIG. 1 is a somewhat schematic view of a boat having a through hull assembly incorporated in its drive with the tubular housing of the assembly extending through the skeg of the boat.

In FIG. 1, a drive for the propeller 5 of a boat is shown as connected to the drive shaft of the engine 6 with the drive having a shaft 7 connected thereto by a flexible joint 8 and supported by a central bearing 9 connected to the hull 10 and located between universal joints 11 and 12 with the universal joint 12 connected to the through hull assembly, generally indicated at 13 by a flexible joint 14.

Figure 2:
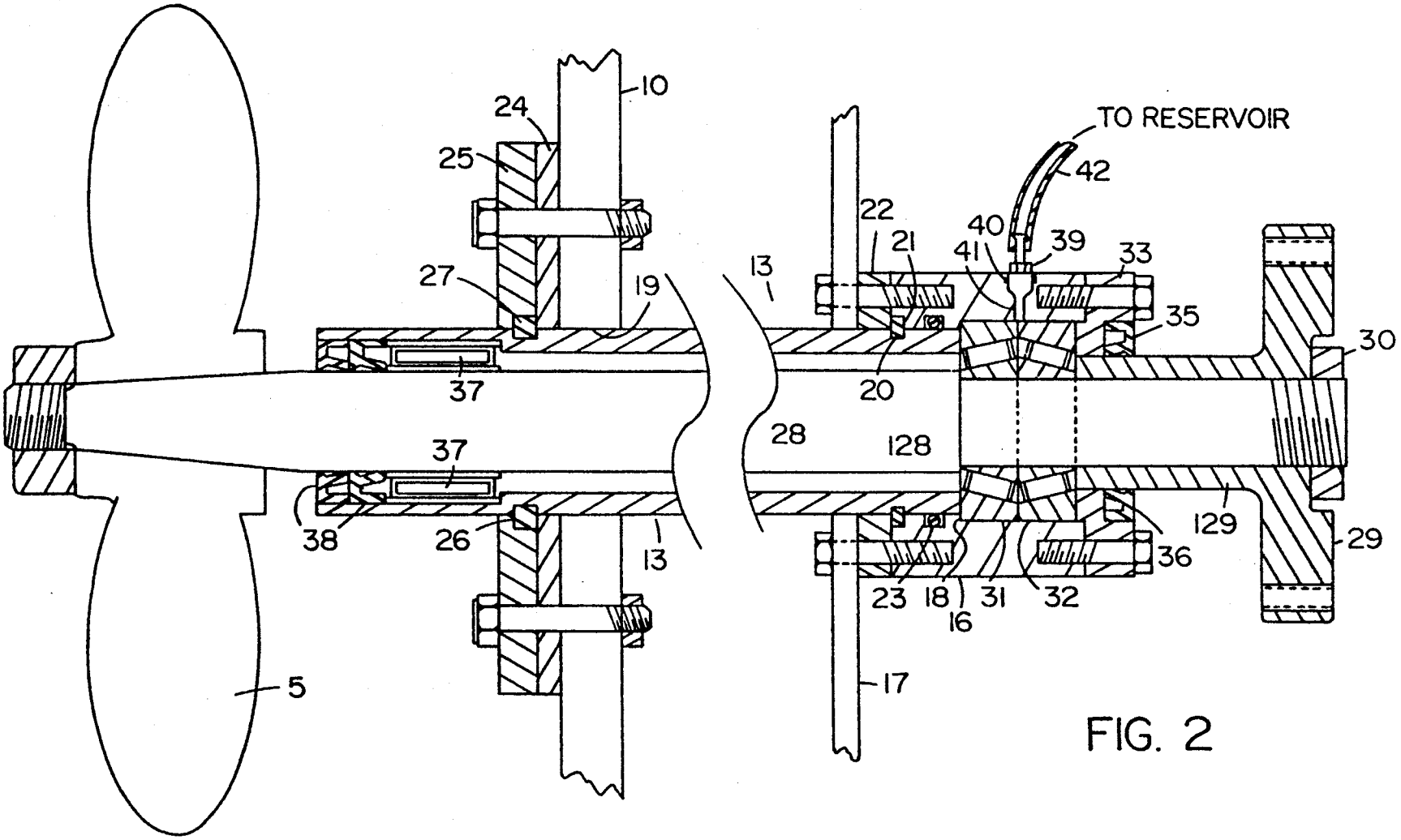
FIG. 2 is a lengthwise section of the through assembly of FIG. 1.
Figure 3:
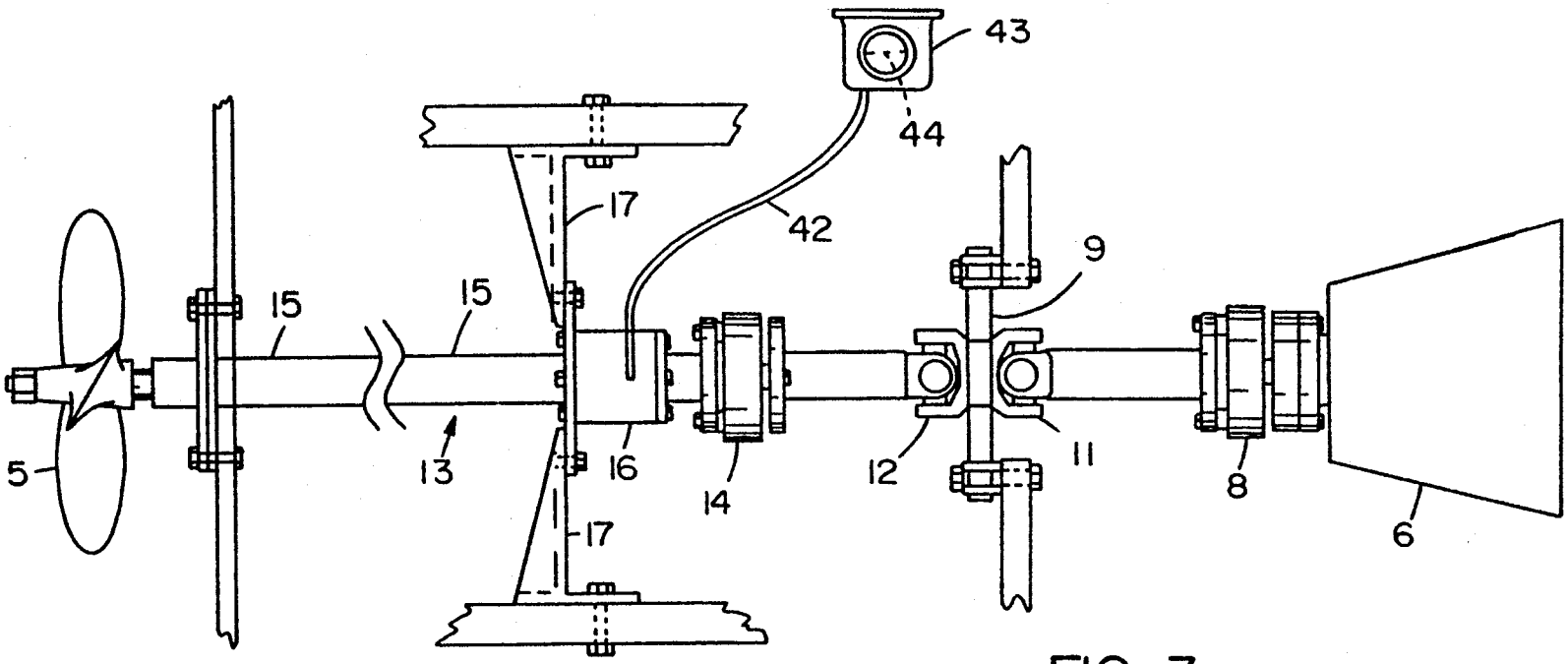
FIG. 3 is a somewhat schematic plan view of the components of a marine drive in accordance with the invention.

The through hull assembly 13 has an open ended housing consisting of a rearwardly disposed tubular section 15 and a forwardly disposed section 16 held by a transverse member 17 which is shown as secured to the hull 10 which, in the disclosed embodiment, functions as a thrust plate. The housing section 16 is annular with a shoulder 18, see FIG. 2, dividing its interior into rearwardly and forwardly opening portions with the inside diameter of the forwardly opening greater than that of the rearwardly opening portion which is such as to accommodate the inboard end of the housing section 15.

The tubular section 15 is of a length to extend through a passageway 19 in the skeg of the hull 10 with its inboard end entered in the rearwardly opening portion of the housing section 16 until the stop ring 20 engages the annular shoulder 21 at the entrance of the rearwardly opening housing section 16. A clamping ring 22 is bolted to the rearwardly opening section and holds the stop ring 22 seated against the shoulder 21 with leakage prevented by an annular seal 23.

The outboard end portion of the tubular section 15 has end plates 24 and 25 fitted thereon and bolted against the outer face of the skeg. The plate 25 has a shoulder 26 in its inner surface to receive the seal 27.

A shaft 28 extends freely through both sections of the housing with its ends exposed. The exposed outboard end of the shaft 28 is formed to enable the propeller 5 to be secured thereon. The inboard end of the shaft 28 is of reduced diameter providing a shoulder 128 within the section 16 in the plane of the shoulder 18. A flange 29 has a sleeve 129 fitted on the outer end of the shaft 28 and is secured thereon by a nut 30 threaded on the inboard end of the shaft 28. The flange 29 enables the shaft 28 to be connected to the proximate flexible joint 14.

The forwardly opening portion of the housing section 16 contains an inner rearward roller bearing unit 31 and an outer forward roller bearing unit 32 in support of the shaft 28 and have their races in mutual contact with their outer races held seated against the forward end of the tubular housing section 15 and their inner races held seated against the shaft shoulder 128 by a clamping ring 33 bolted to the forward end of the housing section 16. The bearing units 31 and 32 are disposed to accommodate thrust in opposite directions. The ring 33 has an annular shoulder 35 extending into the housing section 16 providing support for the annular seal 36 which is in sealing contact with the sleeve 29. The shoulder 35 also holds the outer races of the units 31 and 32 against the end of the tubular section 15. The inner races of the units 31 and 32 are backed by the shaft shoulder 128. The forward bearing unit 32 is spaced from the open end of the section 16 to provide a recess which receives the annular shoulder 35 holding the shaft seal 36 in sealing contact with the shaft sleeve 129.

It will be noted that the shaft 28 is a free fit within the tubular housing section and adjacent the outboard end thereof, the shaft 28 is supported by roller bearings 37 spaced from the outboard end of the housing 15 to provide a recess for a pair of shaft seals 38. At the outboard end, the shaft is sealed, in practice by a pair of annular seals 38 and the inboard end by the seal 36 shown as of the type having V-shaped recesses opening towards a source of expanding pressure in the interior of the housing sections.

The housing section 16 has a fitting 39 in a bore 40 forwardly of the seal 23 which registers with a port 41 in the housing section 15. A conduit 42 from a reservoir 43 for oil or other lubricant is connected to the fitting 39 enabling the housing sections to be filled with the lubricant. As the reservoir 43 is mounted above the assembly at a wanted height, a head is maintained on the lubricant and against the seals 36 and 38 and in some installations, the reservoir may be pressurized. It will be noted that the reservoir 43 has a horizontal line 44 establishing the normal level of the lubricant therein with a drop in that level indicating leakage.

Figure 4:
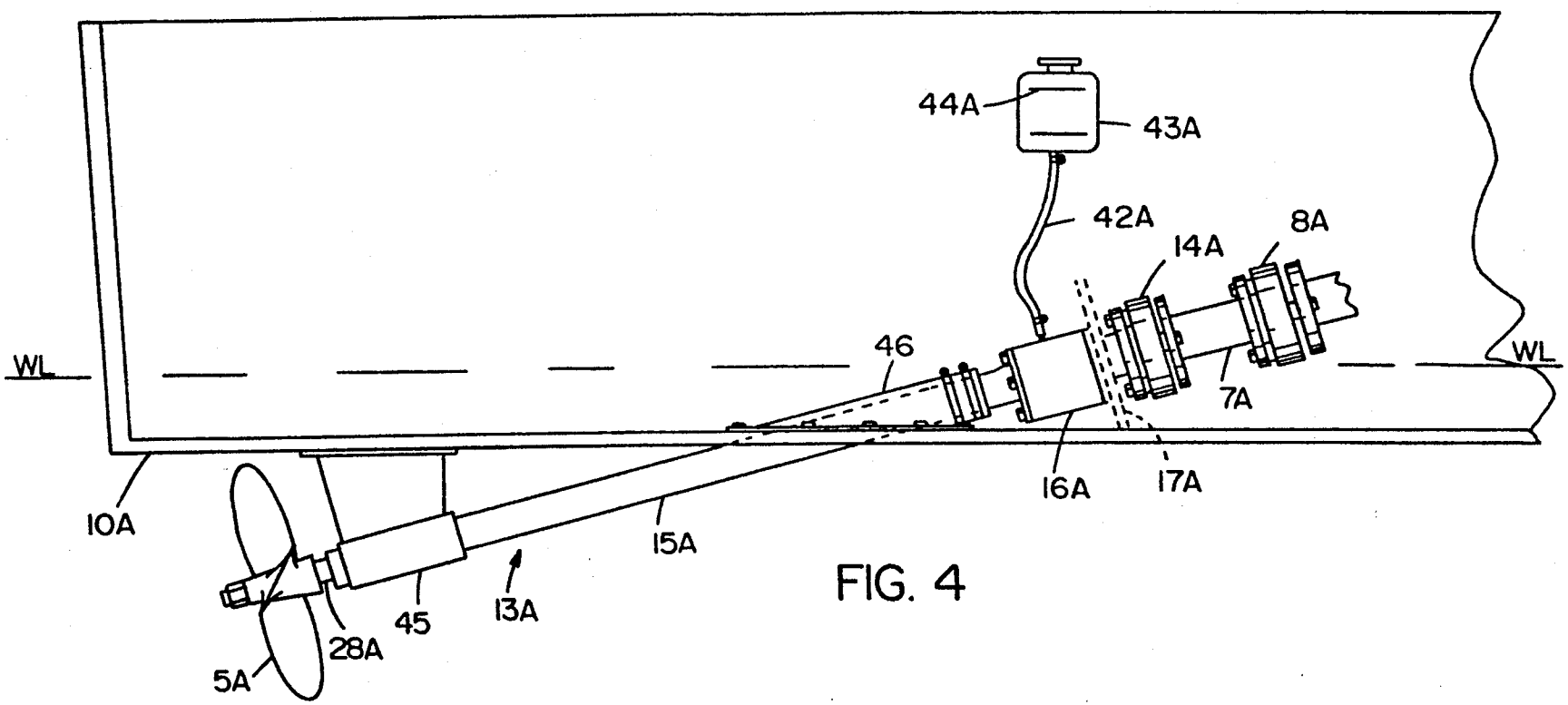
FIG. 4 is a fragmentary view of an assembly in accordance with the invention in which the tubular housing extends downwardly and rearwardly through the bottom of the hull.

The embodiment of the invention illustrated by FIG. 4 employs a through hull assembly 13A which is substantially identical to the above described assembly 13 and will not, therefore, be detailed. Corresponding parts are identified by the same reference numerals distinguished by the suffix addition "A".

In FIG. 4, the assembly 13A extends downwardly and rearwardly through the bottom of the hull 10A and the outboard portion of its shaft 28A and the tubular housing 15A are substantially longer than in the case of the assembly 13, the tubular housing 15A is held in a strut 45.

The assembly 13A is held inboard as by a thrust plate 17A anchored to the hull 10A and is encased by a seal 46 secured to the hull 10A and sealing the hull passageway, not shown, through which the assembly 13A extends.

From the foregoing, it will be apparent that the invention not only eliminates leakage through the passageway required for marine drives but also ensures lubrication of all the bearings of an assembly in a manner enabling any seal leakage to be detected.

I claim:

1. A through hull assembly to be incorporated in a marine drive, the assembly including an elongated open ended housing having inboard and outboard end portions, the housing extending outwardly through a passageway in the hull with the outboard end portion submerged below the water line of the hull, means connecting the housing to the hull in a manner sealing the passageway, inboard means connecting the housing to the hull to prevent the turning of the housing, a propeller shaft freely fit within the housing and of a length to extend through the housing with the shaft ends extending beyond the ends of the housing, a propeller fixed on the end of the shaft protruding from the outboard end portion, shaft bearings within the inboard and outboard end portions of the housing and spaced from the open ends thereof to provide end recesses, shaft sealing means in each end recess, the housing provided with a port for the entrance of bearing lubricant, the volumetric capacity of the housing being such that the bearings are immersed in the lubricant with the sealing means preventing the escape of the lubricant from either end of the housing, the bearings and sealing means in each end portion removable through the open end thereof.

2. The through hull assembly of claim 1 and an inboard lubricant reservoir is positioned above the housing to provide a head on the lubricant in the housing, the reservoir provided with a lubricant level indicator to enable any leakage through the sealing means to be visually detected by a drop below a predetermined level of the lubricant in the reservoir due to a drop in the head thereon.

3. The through hull assembly of claim 2 in which the housing is so disposed that the shaft is inclined rearwardly and downwardly with respect to the water line of the hull, the head on the lubricant then at a maximum on the sealing means in the recess of the rearward end portion of the housing.

4. The through hull assembly of claim 1 in which the assembly includes a section having a passageway extending from end to end thereof and provided with a shoulder dividing the passageway into forward and rearward portions, the rearward portion dimensioned to receive the inboard end of the housing, means to clamp the received inboard end of the housing in a predetermined position with the extremity thereof in a plane inclusive of the shoulder, sealing and bearing means in the forward portion of the section and means clamping the bearing means against the shoulder and the received end of the housing.

5. The through hull assembly of claim 4 in which the means clamping the bearing means against the shoulder include a ring connected to the open end of the section and provided with an annular shoulder and holding the bearing means against the first mentioned shoulder and an end flange includes a sleeve fitted on the inboard end of the shaft and means connecting the end flange to said shaft end and the inboard sealing means are between the ring and the sleeve.

6. The through hull assembly of claim 5 in which the bearing means consist of two roller bearing units, each adapted to accommodate thrusts in a direction opposite to the other, the outer races of the units held by the ring against the shoulder and the inner races held by the sleeve.

* * * * *